United States Patent [19]

Machate et al.

[11] Patent Number: 4,962,962

[45] Date of Patent: Oct. 16, 1990

[54] PIECE OF SEATING FURNITURE

[75] Inventors: Rainer Machate, Biebertal; Robert Vonhausen, Giessen; E. Hansen, St. Margrethen, all of Fed. Rep. of Germany

[73] Assignee: VOKO Franz Vogt & Co., Pohlheim, Fed. Rep. of Germany

[21] Appl. No.: 142,041

[22] Filed: Jan. 7, 1988

[30] Foreign Application Priority Data

Jan. 9, 1987 [DE] Fed. Rep. of Germany ..... 3700447

[51] Int. Cl.[5] ..... A47C 3/00

[52] U.S. Cl. ..... 297/300; 297/301; 297/302

[58] Field of Search ..... 297/300, 302, 301, 304, 297/305

[56] References Cited

U.S. PATENT DOCUMENTS

| | | | |
|---|---|---|---|
| 1,909,018 | 5/1933 | Sengpiel | 297/301 |
| 2,321,385 | 6/1943 | Herold | 297/301 |
| 2,374,350 | 4/1945 | Herold | 297/301 |
| 2,471,024 | 5/1949 | Cramer | 297/301 |
| 2,619,153 | 11/1952 | Van Oosclen | 297/302 |
| 3,034,828 | 5/1962 | Kuriliara | 297/304 |
| 4,629,249 | 12/1986 | Yamaguchi | 297/300 |
| 4,682,814 | 7/1987 | Hansen | 297/300 |
| 4,709,962 | 12/1987 | Steinmann | 297/300 |
| 4,761,033 | 8/1988 | Lanuzzi et al. | 297/301 |
| 4,779,925 | 10/1988 | Heinzel | 297/301 |

FOREIGN PATENT DOCUMENTS

| | | | |
|---|---|---|---|
| 1174489 | 11/1958 | France | 297/301 |

*Primary Examiner*—Francis K. Zugel

*Attorney, Agent, or Firm*—Jones, Tullar & Cooper

[57] ABSTRACT

The underlying object is to create a piece of seating furniture with which an automatic, bodyweight-dependent setting of the restoring force of the inclination mechanism and of the back part mechanism takes place.

According to the invention, the seat part (2) is mounted on the seat carrier (5) vertically adjustably by means of a parallelogram linkage arrangement (9, 10) against the pretensioning force of a spring element (16), furthermore the back carrier (4) is mounted pivotally on the seat carrir (5), a pivoting of the back carrier (4) taking place against the pretensioning force of the spring element (16).

The piece of seating furniture according to the invention can be used, for example, as office furniture, as a seat in a motor vehicle or in the domestic sector.

21 Claims, 9 Drawing Sheets

PIECE OF SEATING FURNITURE

Figure 2:
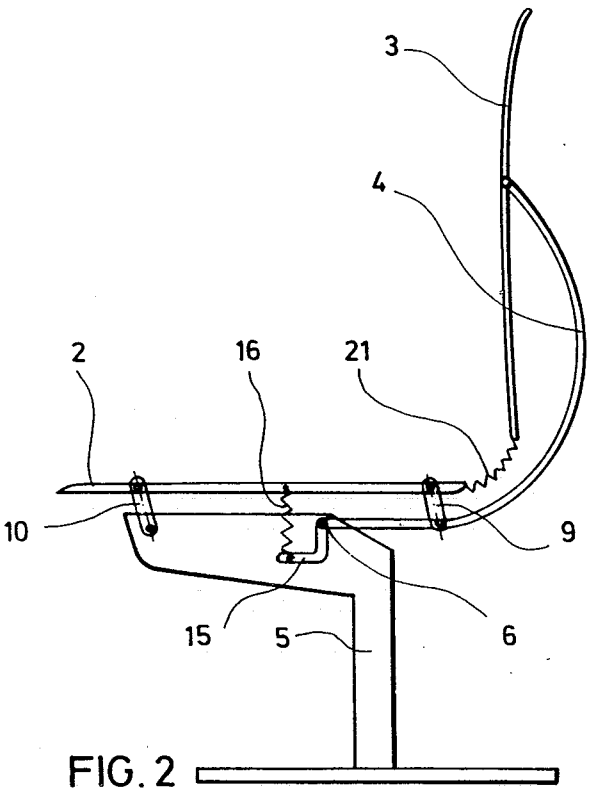

The invention relates to a piece of seating furniture, in particular an office chair, an armchair or the like, with a seat carrier, a seat part articulated to the seat carrier and a back part supported on a back carrier, the supporting force of the back part being adjustable.

In the case of known seating furniture, the seat part and/or the back part is adjustable in its inclination, simple office chairs usually only having a back carrier which is resiliently fixed on the seat carrier and on the upper end of which a vertically adjustable back part is mounted. In the case of more comfortable seating furniture, for example office chairs, a continuous seat shell is provided, which comprises both the seat part and the back part. The fixing of the back part in this case usually takes place via more complicated mechanical devices, such as are known for example from DE-A-No. 1 35 20 188.

In the case of known seating furniture, an adjustment of the back part in an angular range of approximately 5° toward the seat part and approximately 15° to 20° away from the seat part (referred to the position of rest of the piece of seating furniture) is possible. This takes place by means of a manual adjustment mechanism which influences the position of the back carrier or acts on a spring element arranged in the region of the mount of the back carrier. An adjustment of the inclination of the back carrier or of the supporting force applied by the latter is necessary to make possible an adaptation of the piece of seating furniture to the weight of the person sitting on it. In the case of lightweight persons, only a small supporting force is necessary, while heavier persons require a correspondingly larger supporting force of the back carrier and of the back part. Furthermore, it is necessary in the case of known seating furniture to adapt the position of the back carrier and of the back part to the size of the person sitting on the piece of seating furniture.

A multiplicity of considerable disadvantages arises from all this. Firstly, the manual setting is time-consuming and complicated, so that usually whenever the piece of seating furniture is only to be used for a short time by a person to whom the piece of seating furniture has not been adapted, such an adaptation is dispensed with. This leads to uncomfortable sitting and possible also to detrimental health effects. Furthermore, it is necessary in the case of the known seating furniture that the respective user first determines by trial sitting whether the piece of seating furniture has to be adjusted or whether it can be used in the existing setting. Such adjustment operations or adaptation operations prove disruptive and disadvantageous in particular whenever the piece of seating furniture is used frequently by different persons, as is the case for example with office chairs which are assigned to a specific workplace which is only used briefly, for example a telex machine or a VDU terminal.

The invention is based on the object of creating a piece of seating furniture with which, by simple design and reliable handling properties, a setting of the restoring force of the seat area and of the supporting force of the back part takes place automatically in dependence on the weight of the person sitting down on the piece of seating furniture and which avoids the disadvantages known from the prior art.

The object is achieved according to the invention in that the seat part is mounted on the seat carrier vertically adjustably by means of a parallelogram linkage arrangement against the force of a spring element and in that the back carrier is mounted pivotally on the seat carrier, a pivoting movement of the back carrier taking place against the force of the spring element.

The piece of seating furniture according to the invention has a series of considerable advantages over the known seating furniture. For example, it is possible to dispense with all manual adjustment since an adaptation to the weight of the respective person takes place immediately via the force of the spring element as soon as the person has sat down on the piece of seating furniture. Since all that is necessary for adjustment is a loading of the seat part by the weight of the respective person, any necessity for a mechanical adjustment is eliminated. In this way, on the one hand it is ensured that the back carrier or the back part mounted on the latter constantly exerts an adequate supporting force, so that accidents which occur by heavy persons leaning back too far and not being able to be supported by the back part can be avoided. Furthermore, it is not necessary to undertake vertical adjustments of the back part since no adaptation of the lever arm of the back part or back carrier is necessary in order to adjust the corresponding supporting force.

In a favorable embodiment of the piece of seating furniture according to the invention, the back carrier is mounted on the seat carrier via a pivot bearing arranged fixedly on the seat carrier, a free lever arm, jutting out beyond the pivot bearing, of the back carrier being in pressure contact against the spring element. A loading of the seat part compresses the spring element in dependence on the weight of the user. If the back part is leaned against, it can pivot at the seat carrier and be supported against the compressed spring element. In this way, it is possible particularly simply to establish a direct relation between the weight of the user and the supporting moment applied by the back carrier.

A favorable further development is also constituted in that the lever arm of the back carrier is arranged horizontally and is supported against the spring element arranged vertically between the seat part and the lever arm. This arrangement makes possible a particularly space-saving design. In comparison, it may prove advantageous also that a front linkage, mounting the seat part on the seat carrier, is designed as a double lever, the downwardly pointing end region of which is supported against the substantially horizontally arranged spring element, which is arranged between the double lever and the lever arm. In the case of this design, it is possible to increase the overall length of the spring element considerably, as a result of which an adaptation of the piece of seating furniture over a wide weight range is possible.

In a particularly preferred embodiment, the seat part is mounted on the seat carrier by means of a front linkage and on the back carrier by means of a rear linkage. In this arrangement, a loading of the seat part in the way described leads to a compressing of the spring element. If there is a loading of the back part, i.e. if the person sitting on the piece of seating furniture leans back, the part of the seat part facing the back carrier is also lowered somewhat, however. This increases the sitting comfort to a considerable extent and, depending on the structural design, i.e. on the particular leverage ratio chosen, may lead to a considerable additional adaptation capability, since a change in the supporting force of the back part in adaptation to the weight of the person and in adaptation to the loading of the piece of seating furniture already takes place with a slight loading of the back part whenever the person sitting on the piece of seating furniture leans back, brought about alone by the loading of the region of the seat carrier facing the back carrier.

A particularly advantageous further development of the piece of seating furniture according to the invention consists in that the seat part is mounted on the seat carrier by means of a front linkage at a pivot bearing fixed in place on the seat carrier, in that a linkage rod is mounted at the pivot bearing and in that the linkage rod is mounted on the seat part by means of a first linkage pivotally mounted on the seat part and mounted in its central region on the linkage rod, and in that the free end of the first linkage is connected via a link guide, formed on a second linkage, to the second linkage mounted fixedly pivotally on the seat carrier. In contrast to the exemplary embodiment described above, this further development of the piece of seating furniture according to the invention has the advantage that a pivoting of the parallelogram linkage arrangement not only has the effect of compressing a spring element but also of changing the overall leverage ratio. In this way, it is possible to change the point of force application on the spring element. The change in the point of force drive takes place, in the case of this exemplary embodiment, by the second mounting point of the parallelogram linkage arrangement to the seat carrier taking place via a second linkage, in other words not fixedly. Since a link guide is provided between the first linkage and the second linkage, variations in the effective length of the second linkage are produced, in dependence on the loading of the seat part.

In a further development of the latter-mentioned exemplary embodiment, advantages arise in particular from the fact that the spring element is mounted on the seat carrier at the point of articulation of the second linkage and on the seat part at the point of articulation of the front linkage. In this way, a greatest possible length of the spring element can be achieved, which leads to an adjustability of the piece of seating furniture in a particularly wide weight range.

In particularly advantageous further development, a second spring element is mounted on the pivot bearing, the drive end of which spring element is mounted on the second linkage. The second spring element serves the purpose of applying an additional supporting force to the back part. Since the second spring element is mounted on the second linkage, changes in the point of force application of the second spring element also occur when there is a loading of the seat part due to the interaction of the first linkage and of the second linkage, so that the compression of said second spring element is changed correspondingly.

It proves particularly favorable if the second linkage is designed substantially T-shaped, the spring element and the second spring element each being mounted at the extreme end of the cross member of the T, while the link guide is formed substantially along the end region of the free end of the T. In this way, the second linkage is designed in the form of an angle lever, as a result of which the change in the point of force drive and of the respective lever arms can be performed in a particularly effective way.

Figure 1:
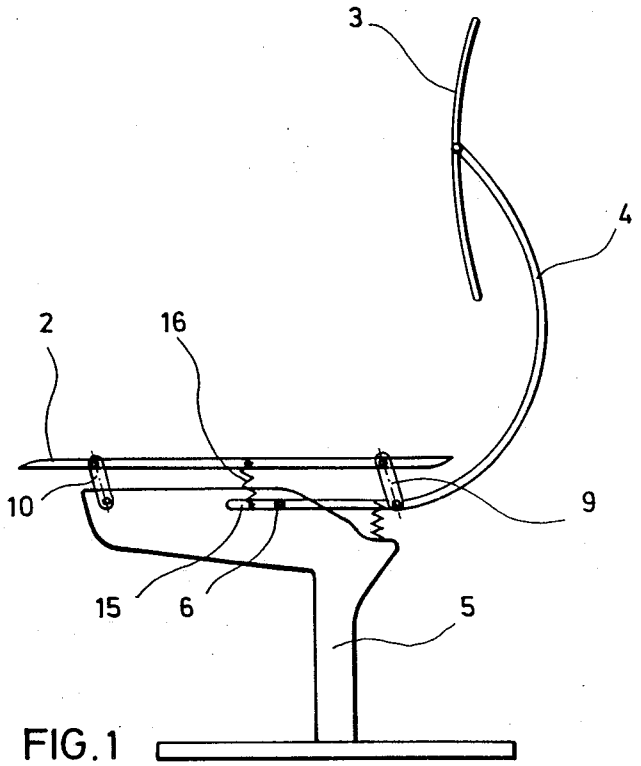
Figure 4:
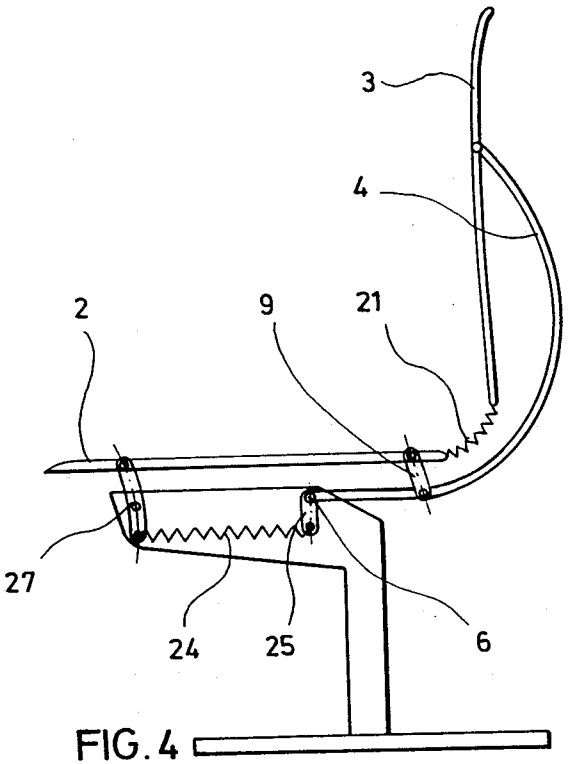
Figure 3:
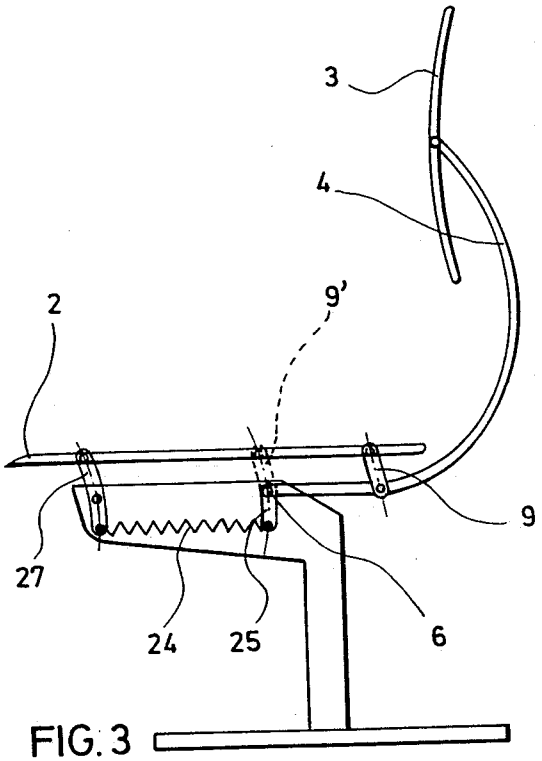
Figure 5:
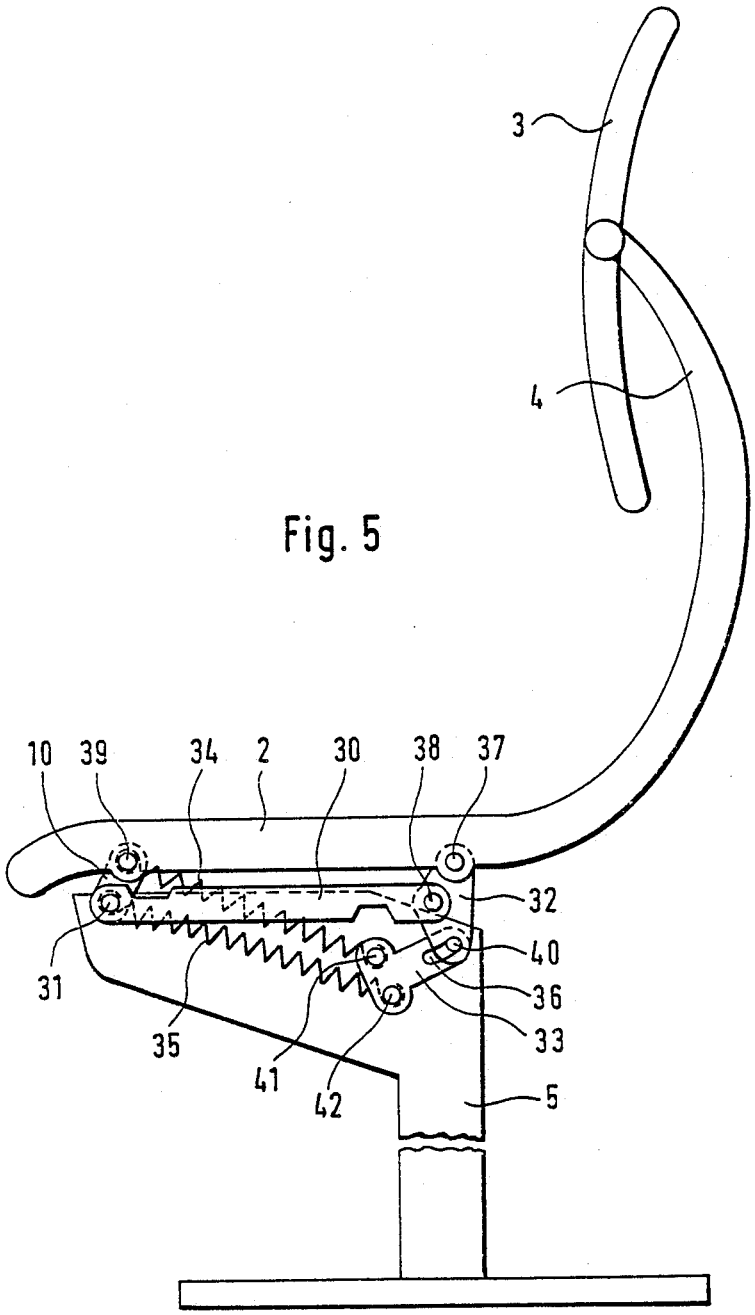
Figure 5A:
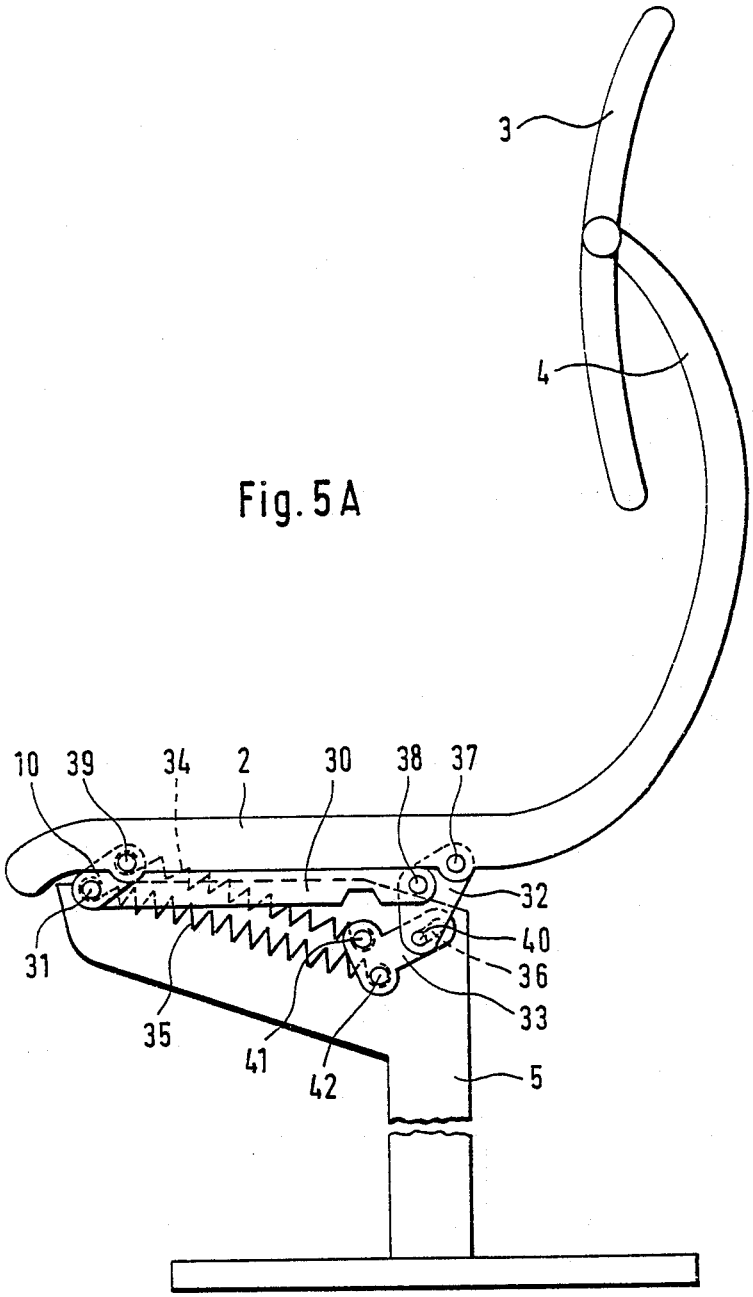
Figure 5B:
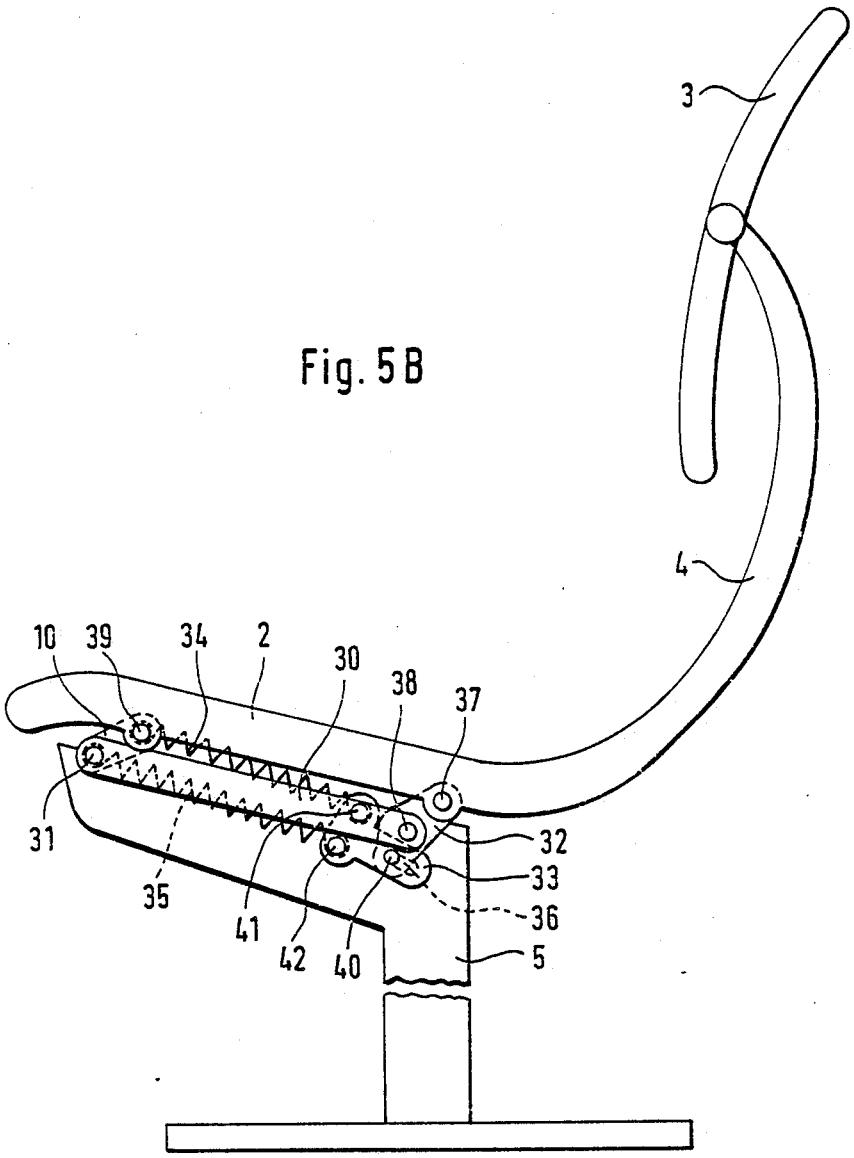
Figure 5C:
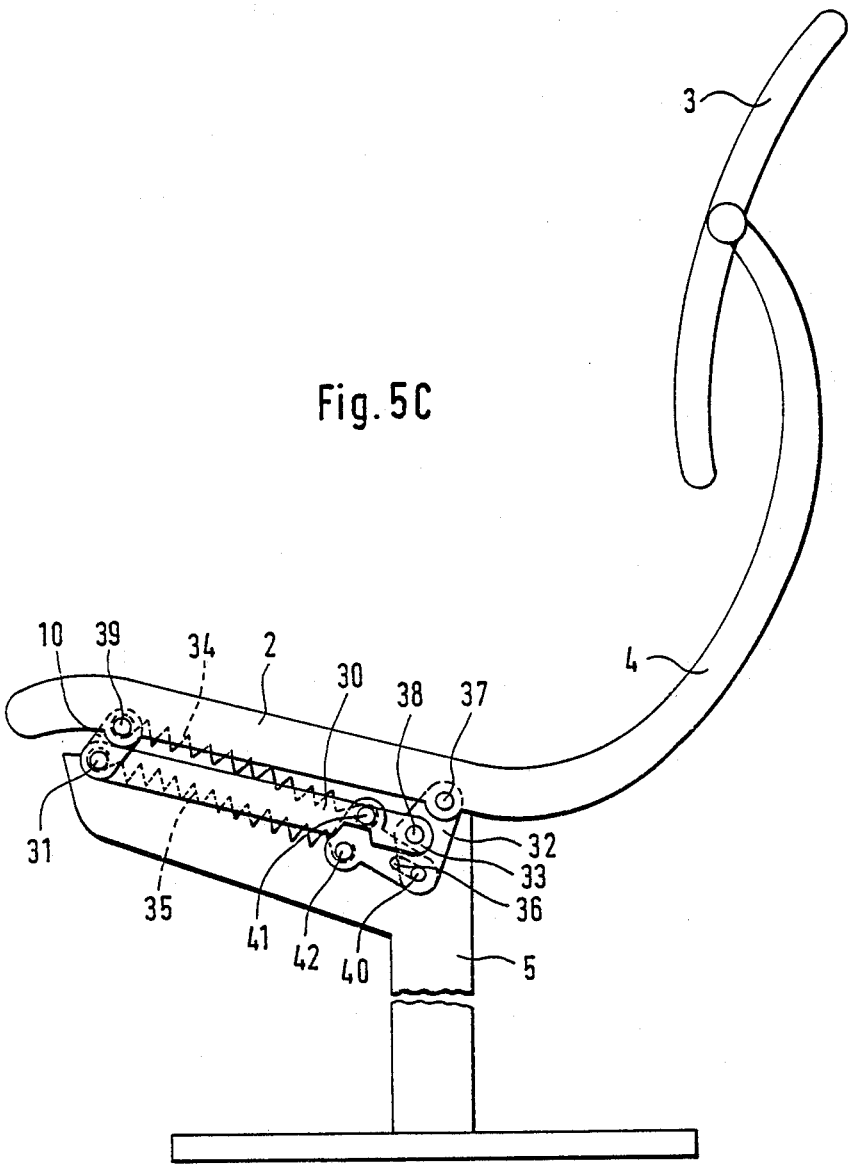
Figure 6:
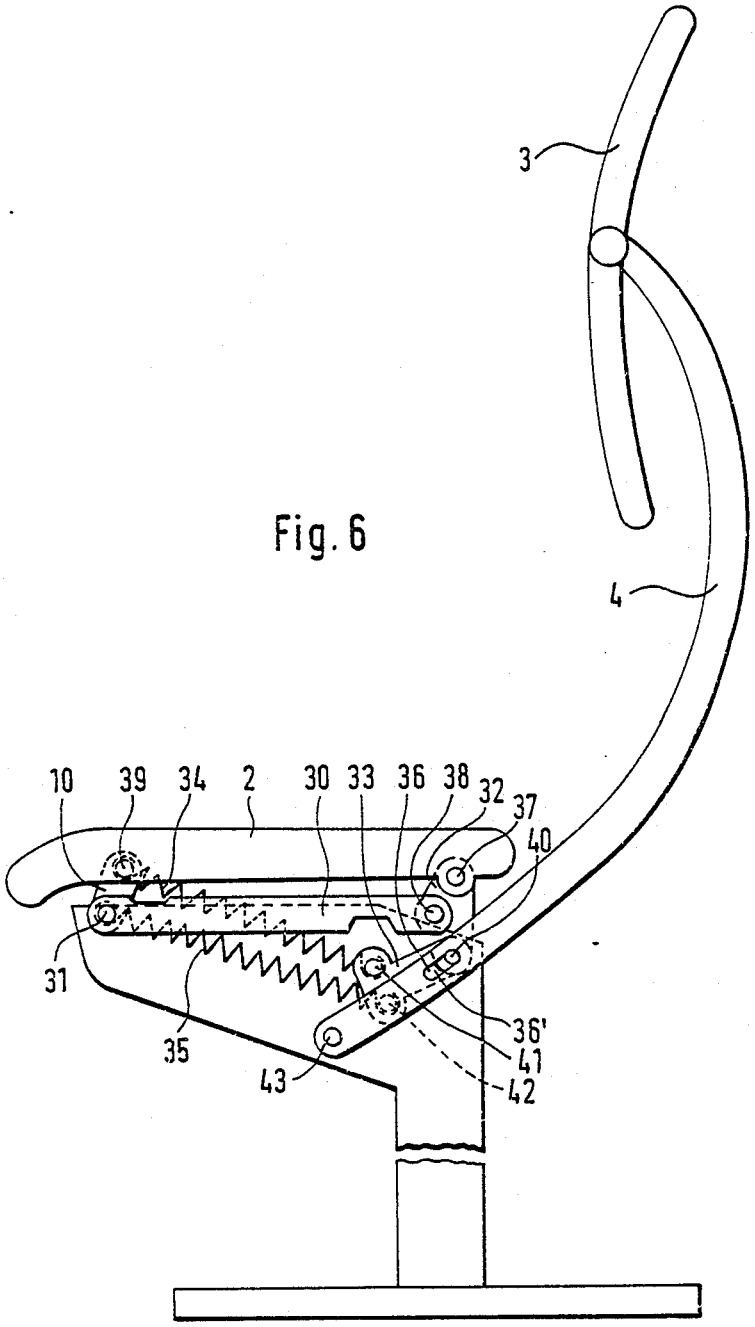
Figure 6A:
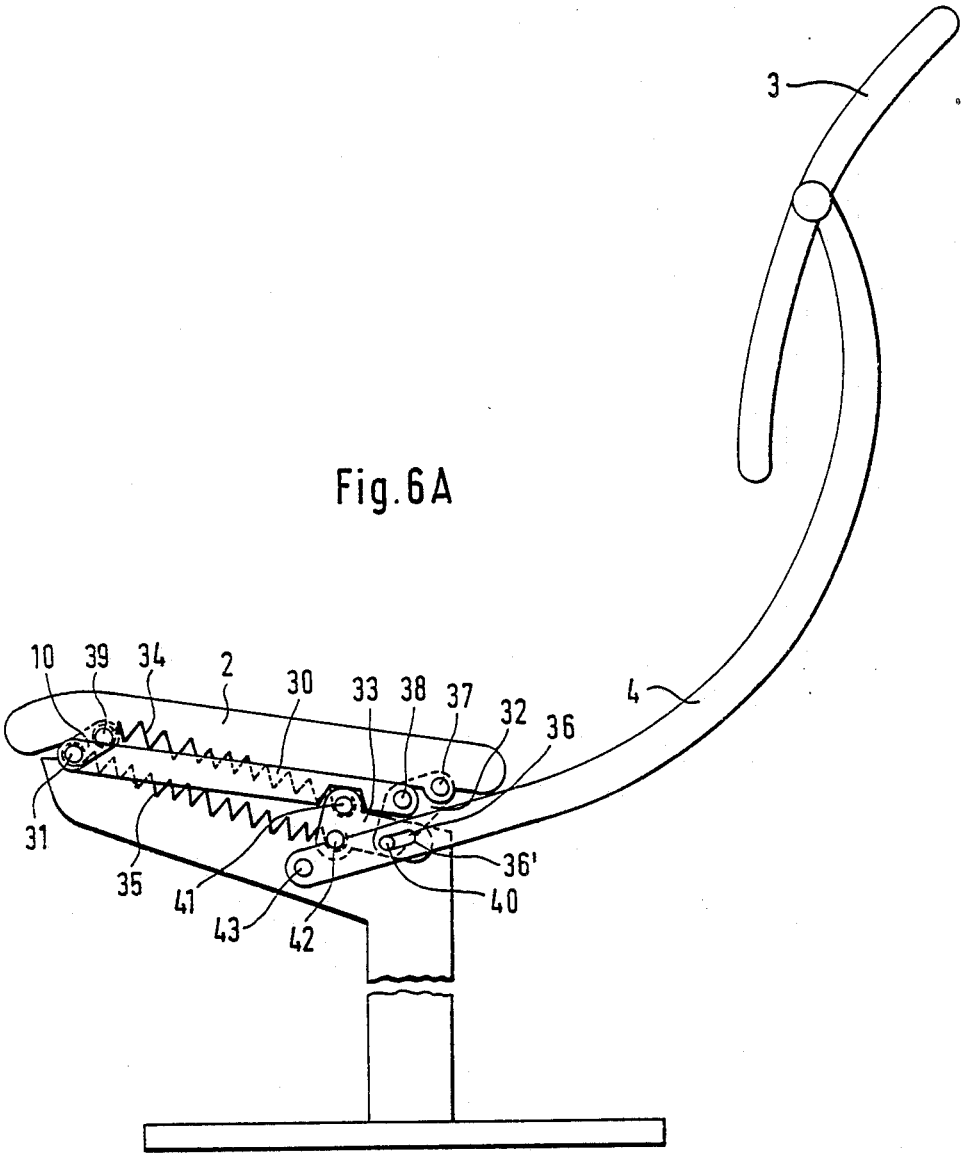
Figure 6B:
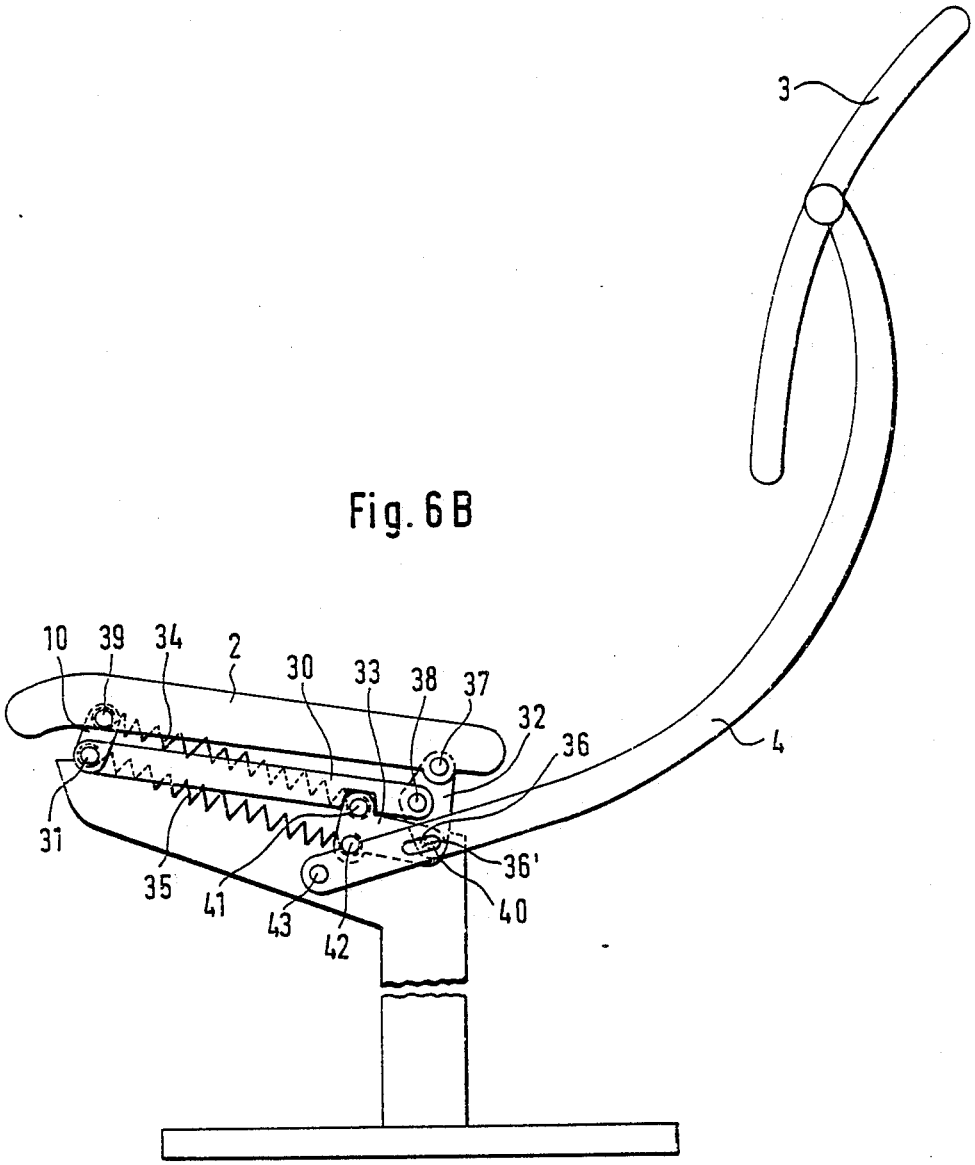

The invention is described below with reference to exemplary embodiments in conjunction with the drawing, in which:

FIG. 1 shows a diagrammatic side view of a first exemplary embodiment of the piece of seating furniture according to the invention, FIG. 2 shows a diagrammatic side view of an exemplary embodiment similar to the exemplary embodiment of FIG. 1, FIG. 3 shows a diagrammatic side view of a further exemplary embodiment, FIG. 4 shows a diagrammatic side view of a further exemplary embodiment, similar to the exemplary embodiment of FIG. 3, FIG. 5 shows a diagrammatic side view of a further exemplary embodiment, FIGS. 5A–5C show the relative motion of the parts of the embodiment of FIG. 5;

FIG. 6 shows, in diagrammatic side view, a further development of the exemplary embodiment of FIG. 5; and FIGS. 6A and 6B show the relative motion of the parts of the embodiment of FIG. 6.

The piece of seating furniture illustrated in FIGS. 1 to 6, has, in each case, a seat carrier 5, which may be provided in a usual way with feet and additionally with rollers. For the mounting of a seat part 2, the seat carrier 5 has at its upper end a substantially horizontally arranged region.

In the case of the exemplary embodiment which is shown in FIG. 1, the seat part 2 is mounted on the seat carrier 5 by means of a front and a rear linkage 10, 9. The seat part 2, the linkages 10, 9 and the corresponding region of the seat carrier 5 form a parallelogram. When there is a loading of the seat part 2, the latter can pivot in vertical direction about the points of articulation of the linkages 10, 9. Due to the parallelogram-like mounting, a slight horizontal displacement of the seat part 2 also takes place when the latter is loaded. A back carrier 4 is mounted on a pivot bearing 6 and bears a back part 3 at its upper end. The back part 3 may be arranged articulated on the back carrier 4, the back carrier 4 may, as usual, have a certain inherent flexibility. As a departure from the mounting principle generally described above of the seat part 2 on the seat carrier 5, in the case of the exemplary embodiment shown in FIG. 1, the rear linkage 9 is articulated directly to a horizontal part of the back carrier 4. The back carrier 4 has an end region jutting out beyond the pivot bearing 6, which end region likewise extends substantially in horizontal direction and serves as lower contact for a spring element 16, which is supported by its upper region against the seat part 2. In the region of the rear linkage 9, a further spring element 16' is arranged between the horizontal part of the back carrier 4 and the seat carrier 5. The spring element 16' also extends in vertical direction.

When there is a loading of the seat part 2, the latter is pressed downward, due to the parallelogram-like arrangement. This leads to a loading of the spring elements 16, 16', i.e. these spring elements are compressed by the weight of the person sitting on the seat part 2. The pivot bearing 6 forms, as described, a pivoting capability for the back carrier 4, as a result of which the latter can pivot in a usual way by 15° to 20° away from the seat part 2. If an operating person leans back against the back part 3, a pivoting of the back carrier 4 about the pivot bearing 6 consequently takes place. This has the effect, on the one hand, of a loading of the spring 16 and, on the other hand, of a loading of the spring 16'. At the same time, the rear end, facing the back carrier 4, of the seat part 2 is slightly lowered. The compression of the spring elements 16, 16' taking place at the beginning consequently causes a pivoting of the back carrier 4 in dependence on the compression of these spring elements. In this way, an adaptation of the supporting force of the back part 3 to the weight of the person sitting on the seat part 2 is possible.

In the case of the exemplary embodiment illustrated in FIG. 2, identical parts are provided with identical reference numbers. This exemplary embodiment differs from the exemplary embodiment according to FIG. 1 in the design of the jutting-out end region of the back carrier 4. In the unloaded state of the piece of seating furniture, the back carrier 4 extends substantially horizontally between the pivot bearing 6 and the region of the articulation of the rear linkage 9. The region of the back carrier 4 jutting out beyond the pivot bearing 6 is designed in the form of an angle lever in such a way that the point of articulation of the spring element 16 has a greater distance in the vertical direction of the seat part 2 than the remaining, horizontally extending region of the back carrier 4. In this way, it is possible to use only one spring element 16, which is arranged vertically between the jutting-out region of the back carrier 4 and the seat part 2. The mode of operation of the exemplary embodiment shown in FIG. 2 corresponds to that of the exemplary embodiment of FIG. 1.

Furthermore, the exemplary embodiment according to FIG. 2 has a bellows-like, flexible intermediate part 21, which connects the seat part 2 to the back part 3 in such a way that the optical impression of an integral seat shell is evoked. The intermediate part 21 does not perform any function with regard to the adjustment capabilities of the piece of seating furniture.

The exemplary embodiments shown in FIGS. 3 and 4 correspond to the exemplary embodiments of FIGS. 1 and 2 apart from the differences described below. Identical parts have been provided with identical reference symbols. As a difference from the exemplary embodiments of FIGS. 1 and 2, in the exemplary embodiments of FIGS. 3 and 4 a horizontally arranged spring element 24 is provided. The front linkage 10 (FIGS. 1 and 2) has been replaced by a double lever 27, the upper region of which is articulated to the seat part 2 and to the seat carrier, and consequently corresponds in its function to the front linkage 10 of FIGS. 1 and 2. The double lever 27 has a freely jutting-out lower end, which is in contact with the spring element 24. The other end of the spring element 24 is in contact with an angled-off region of the back carrier 4, which forms a lever arm 25. The lever arm 25 preferably extends in vertical direction and has a right angle to the horizontally extending region of the back carrier 4.

The mode of operation of the piece of seating furniture according to the exemplary embodiments of FIGS. 3 and 4 corresponds to the mode of operation described in conjunction with FIGS. 1 and 2. Here too, a loading of the seat part 2 leads to a compression of the spring element 24, so that the back part 3 can apply a supporting moment to the back of the user of the piece of seating furniture, which moment is adapted to the weight of the person due to the compression of the spring element 24.

In FIG. 3, a further design variant is illustrated by broken lines. According to this design variant, the end, facing the back carrier 4, of the seat part 2 is mounted by means of the rear linkage 9 not on the back carrier 4 but directly on the pivot bearing 6 arranged fixedly with the seat carrier 5. Thus, although a loading of the seat part 2 has the effect of a compression of the spring element 24, the seat part 2 remains in its substantially horizontal position, there is no tilting when the user leans against the back part 3. This may prove advantageous if a changing in the seat position is undesired.

In FIG. 5, a further exemplary embodiment of the piece of seating furniture according to the invention is illustrated, in which again identical parts have been provided with identical reference numbers. In the case of this exemplary embodiment, the seat part 2 is articulatedly connected at its front region to the seat carrier 5 by means of the front linkage 10. The connection of the front linkage 10 to the seat part 5 takes place via a pivot bearing 31 which is arranged fixedly on the seat carrier 5. On the pivot bearing 31 there is articulatedly arranged a linkage rod 30 extending substantially parallel to the seat part 2. The region of the seat part 2 facing the back carrier 4 is articulatedly connected to a first linkage 32, to which the linkage rod 30 is also articulated. The first linkage 32 is connected to the seat part 2 via a pivot bearing 37, which has a distance from a pivot bearing 38, at which the linkage rod 30 is articulated to the first linkage 32. A joining line of the pivot bearings 37 and 38 is substantially parallel to the front linkage 10. The distance between a pivot bearing 39, at which the seat part 2 is connected to the front linkage 10, and the pivot bearing 31 substantially corresponds to the distance between the pivot bearings 37 and 38. A parallelogram is consequently formed by the seat part 2, as well as linkage rod 30, the front linkage 10 and the first linkage 32.

The first linkage 32 has, at its lower end, at a distance from the pivot bearing 38 and the pivot bearing 37, a further pivot bearing 40, which is displaceable in a link guide 36 of a second linkage 33. The second linkage 33 is mounted fixedly to the seat carrier 5 at a pivot bearing 41. Consequently, the second linkage 33 can be pivoted about the pivot bearing 41 if the seat part 2 is moved in substantially vertical direction in its rear region facing the back carrier 4, i.e. if a user sits down on the seat part 2. The link guide 36 is designed in the shape of a slot, which does not yet extend in a straight direction but has a curvature which is provided with a radius which corresponds to the distance between the pivot bearings 38 and 40.

Between the pivot bearings 39 and 41 there is arranged a spring element 34 which has the effect of supporting the seat part 2. When there is a loading of the seat part 2, the spring element 34 is compressed.

The second linkage 33 is designed in the shape of an angle lever and has substantially a T-shaped design. The link guide 36 is formed at the central region of the T-shaped second linkage 33, while the pivot bearing 41 is provided at the end region of the T region extending in transverse direction. Opposite the pivot bearing 41 there is provided a pivot bearing 42, at which a second spring element 35 is articulated, the other end of which is fixed at the pivot bearing fixedly secured to the seat carrier 5.

In the unloaded position of the piece of seating furniture, the spring element 34, which supports the seat part 2 with respect to the seat carrier 5, to which the spring element 16 of FIGS. 1 to 4 corresponds, pushes the first linkage 32 into the upwardly right pointing end of the link guide 36 of the second linkage 33. When ther is a loading of the seat part 2, the first linkage 32 is correspondingly displaced in the link guide 36, so that the pivot bearing 40 is displaced in the link guide 36 toward the pivot bearing 41 of the second linkage 33. Thus, when there is a displacement of the pivot bearing 40 in the link guide 36 upon a loading of the seat part 2, a reduction in the effective lever length of the second linkage 33 occurs. Since, however, the lever arm which acts on the second spring element 35 via the pivot bearing 42 has remained unchanged, the transmission ratio changes, so that from now on a greater force is necessary for an adjustment of the back carrier 4 in a rearward direction away from the seat part 2. In this way, an automatic adaptation to the weight of the user takes place in that there effective lever arm of the second linkage 33 is changed in dependence on the weight of the user against the compressive force of the spring element 34.

In the case of the exemplary embodiment shown in FIG. 5, the back carrier 4 is connected integrally to the seat part 2. When there is a loading of the back part 3, i.e. when there is a pivoting of the back carrier 4, there thus simultaneously takes place a corresponding lowering of the part facing the back carrier 4 of the seat part 2.

FIG. 5A shows the rotation of the links 10 and 32 upon the application of a weight to seat 2. As shown, the seat remains parallel to the rod 30 and to the top of the chair carrier 5, with the pin 40 sliding along the slot 36 as link 32 rotates. The clockwise rotation of link 10 shortens the spring 34 and the movement of pin 40 shortens the distance between that pin and the pivot point 41.

The device of FIG. 5 also includes a second spring 35 which is connected between the pivot point on the chair carrier 5 and a connection point 42 on the link 33. Point 42 is spaced from the pivot point 41 and is located so that the spring 35 tends to rotate link 33 in a counterclockwise direction. This in turn tends to move the rear of seat 2 upwardly and to restore the back carrier 4 to its upright position. Thus, spring 35 operates to control the return force applied to the brackrest. Since this return force is produced by way of the linkage 33 and 32, the force is dependent upon the location of pin 40 in slot 36, and since this location is dependent upon the weight of the person on seat 2, as explained above, the return force supplied to the backrest is dependent on the weight of the person on seat 2. This is illustrated in FIGS. 5B and 5C, as will be described.

After a weight has been applied to seat 2, as shown in FIG. 5A, a person on the seat who leans back against the backrest 3, 4 will tend to produce a clockwise pivotal motion of the entire seat and backrest assembly, since this is a unitary assembly. Such pivotal motion causes the link 33 to pivot in a clockwise direction about pivot point 41. The rotation of link 33 is caused by the force applied by link 32 through a lever arm determined by the distance between points 41 and 40, and this rotation of link 33 causes a compression of spring 35. As previously noted, since the distance between points 40 and 41 is determined by the weight of the person on seat 2, the lever arm which produces that rotation of linkage 33 is dependent on that weight, and thus the weight controls the force required to compress spring 35.

This may be seen more clearly in FIG. 5C which illlustrates the operation of the chair when used by a person having a weight less than that required to compress spring 34. In that case, the link 10 is not pivoted against spring 34 by the weight of the person, and accordingly link 32 does not pivot to move pin 40 toward pin 41. In that condition, when the person on the seat leans back against the backrest, the seat pivots in a manner illustrated in FIG. 5C, causing link 33 to pivot in a clockwise direction around point 41. Since the distance between pin 40 and point 41 is longer than was the case in FIG. 5B, the link 33 is more easily rotated to compress spring 35 and accordingly the force required to tilt the backrest back (i.e., horizontally in a rearward directon, away from the seat 2) is reduced, and remains responsive to the weight applied to the seat.

The exemplary embodiment illustrated in FIG. 6 corresponds substantially to the exemplary embodiment of FIG. 5, so that identical parts have again been provided with identical reference numbers. The exemplary embodiment of FIG. 6 differs in that the seat part 2 and the back carrier 4 are designed as separate parts. The back carrier 4 is articulatedly connected to the seat carrier 5 at the lower region of the seat carrier 5 at a pivot bearing 43. In its central region, the back carrier 4 has a link guide 36', which corresponds in its design to the link guide 36 and is arranged flush with the latter. The pivot bearing 40 of the first linkage 32 is guided both in the link guide 36 and in the link guide 36'. In the case of the exemplary embodiment of FIG. 6, it is thus possible, in the unloaded state of the piece of seating furniture, to lower the seat part 2 without an adjustment of the inclination of the back carrier 4 taking place. This is ensured by the link guide 36' coinciding with the link guide 36. Outside this region of the link guides 36, 36', the design of the link guide 36 may be made such that the correspondingly desired adjustment of the back carrier 4, and consequently of the back part 3, takes place with the necessary adjustment of the inclination of the seat part 2.

As illustrated in FIG. 6A, when weight is placed on seat 2, the seat moves vertically downwardly, remaining parallel to the carrier 5, and pivoting link 32 to cause pin 40 to move in the manner previously discussed. The pin also moves in slot 36', as shown. This movement of pin 40 toward the pivot point 41 changes the lever arm between the two pins, as previously discussed, thereby increasing the force required to pivot the backrest. FIG. 6B illustrates the same situation as FIG. 5C, where the weight of the person on seat 2 is not sufficient to cause the seat to move vertically, whereby the lever arm between pins 40 and 41 is longer and the force required to pivot the backrest is correspondingly reduced.

The invention is not restricted to the exemplary embodiments shown, rather, many different modified variants are possible within the scope of the invention. The dimensioning and arrangement of the individual linkages is, in particular, variable in a wide range.

In the case of the exemplary embodiments shown, a spring element was always described in a general form. This may be designed in the form of a mechanical compression spring, for example a spiral spring. It is, however, also possible to provide a torsion spring or another type of spring element, for example a pneumatic spring or a combination of a hydraulic and a pneumatic suspension.

We claim:

1. A piece of seating furniture having a seat carrier, a seat part articulated to the seat carrier, and a back part supported on a back carrier to provide a supporting force, the supporting force provided by the back part being adjusted in response to a weight applied to the seat part, characterized in that the seat part is mounted on the seat carrier for vertical adjustment by means of a parallelogram linkage against the force of a spring element, in that the force of the spring element is adjusted in response to the vertical adjustment of the seat part, and in that the back carrier is mounted for pivotal motion with respect to the seat carrier, a pivoting motion of the back carrier taking place against the force of the spring element, the vertical adjustment of the seat part adjusting the supporting force provided by the back part.

2. A piece of seating furniture according to claim 1, characterized in that the back carrier is mounted on the seat carrier by way of a pivot bearing arranged fixedly on the seat carrier and in that the back carrier includes a free lever arm extending from the pivot bearing of the back carrier, the lever arm being in pressure contact against the spring element.

3. A piece of seating furniture according to claim 2, characterized in that the free lever arm is arranged horizontally and in that the spring element is arranged vertically between the seat part and the free lever arm.

4. A piece of seating furniture according to claim 2, characterized in that a front linkage mounting the seat on the seat carrier is a double lever having a downwardly pointing end region and in that the spring element is substantially horizontally arranged between the double lever and the free lever arm.

5. A piece of seating furniture according to claim 1, characterized in that the seat part is connected by means of a flexible intermediate part to the back part for the formation of a continuous seat shell.

6. A piece of seating furniture according to claim 1, characterized in that the seat part is mounted on the seat carrier by means of a front linkage and on the back carrier by means of a rear linkage.

7. A piece of seating furniture having a seat carrier, a seat part articulated to the seat carrier, and a back part supported on a back carrier to provide a supporting force, the supporting force provided by the back part being adjustable, characterized in that the seat part is mounted on the seat carrier for vertical adjustment by means of a parallelogram linkage arrangement including a front linkage having one end pivotally mounted on the seat part and a second end mounted on a pivot bearing fixed in place on the seat carrier, a first rear linkage, and a linkage rod having first and second ends and mounted at its first end to the pivot bearing and at its second end to the seat part by means of the first rear linkage, said rear linkage being pivotally mounted at one end to the seat part and mounted at its central region on the linkage rod, and having a free end, in that the seat part is mounted for adjustment against a compressive force of a spring element, the compressive force being adjusted in response to the vertical adjustment of the seat part, in that the back carrier is mounted for pivotal motion with respect to the seat carrier, and in that the free end of the first rear linkage is connected to a second rear linkage by a link guide formed on the second rear linkage, the second rear linkage being fixedly pivotally mounted on the seat carrier, a pivoting motion of the back carrier taking place against the compressive force of the spring element, the vertical adjustment of the seat part adjusting the supporting force provided by the back part.

8. A piece of seating furniture according to claim 7, characterized in that the parallelogram is formed by the front linkage, the seat part, the first rear linkage, and the linkage rod.

9. A piece of seating furniture according to claim 7, characterized in that the spring element is mounted on the seat carrier at the point of said fixed pivotal mounting of the second rear linkage and on the seat part at the point of said pivotal mounting of the front linkage.

10. A piece of seating furniture according to claim 7, characterized in that the link guide is a slot formed in the second rear linkage.

11. A piece of seating furniture according to claim 7, characterized in that one end of a second spring element is mounted on the pivot bearing, the other end of the second spring element being connected to the second rear linkage at a point spaced from its fixed pivotal mounting point.

12. A piece of seating furniture according to claim 11, characterized in that the second rear linkage is substantially T-shaped, having a cross member and an intersecting leg member, the first-named spring element and the second spring element being mounted at opposite ends of the cross member of the T, while the link guide is formed substantially along the free end of the leg member of the T.

13. A piece of seating furniture according to claim 7, characterized in that the back carrier is integral with the seat part.

14. A piece of seating furniture according to claim 7, characterized in that the back carrier is mounted pivotally on the seat carrier and is provided with a second link guide which, in an unloaded state of the piece of seating furniture, is flush with the link guide formed on said second rear linkage and in that the back carrier is mounted by means of the second link guide on the connection between the first rear linkage and the second rear linkage.

15. A piece of seating furniture which is adjustable in response to the weight of a person seated thereon, comprising;

a seat carrier;

a seat part;

linkage means pivotally connected to said seat part and to said seat carrier and forming an adjustable parallelogram therewith;

a back carrier having a back part supported thereon;

means connecting said back carrier to said seat carrier and to said parallelogram;

spring means connected to said parallelogram to urge said seat part away from said seat carrier, said parallelogram being adjustable to provide vertical movement of said seat part toward said seat carrier to produce a compressive force on said spring means in accordance with the weight of a person seated on the seat part, said spring means further providing an urging force, through said parallelogram, to said back carrier to urge said back carrier forwardly with respect to said seat carrier so that pivotal motion of said back carrier rearwardly with respect to said seat part takes place against said compressive force of said spring means, said spring means providing an urging force on said back carrier in accordance with the weight of a person seated on the seat part.

16. The piece of seating furniture according to claim 15, wherein said means connecting said back carrier to said parallelogram includes said linkage means.

17. The piece of seating furniture according to claim 16, wherein said spring means is a compression device.

18. The piece of seating furniture according to claim 17, wherein said seat part forms one of first and second parallel arms of said parallelogram and wherein said linkage means forms third and fourth parallel arms linking said first and second arms of said parallelogram.

19. A piece of seating furniture according to claim 15, wherein said linkage means includes a front linkage pivotally connected at a top end to the front of said seat part and at a bottom end to said seat carrier, a rear linkage pivotally connected between the rear of said seat part and said seat carrier and parallel to said front linkage, and a linkage rod connected between said front linkage and said rear linkage and parallel to said seat part to form said adjustable parallelogram.

20. A piece of seating furniture according to claim 19, wherein said back carrier is integral with said seat part, whereby said back carrier is pivotally connected to said seat carrier by way of said seat part.

21. A piece of seating furniture according to claim 19, wherein said back carrier is pivotally connected directly to said seat carrier, and is further connected by way of a link guide to said rear linkage.

* * * * *